US006691525B2

(12) United States Patent
Beaverson et al.

(10) Patent No.: US 6,691,525 B2
(45) Date of Patent: Feb. 17, 2004

(54) HOT GAS BYPASS CONTROL FOR CENTRIFUGAL CHILLERS

(75) Inventors: Gregory K. Beaverson, York, PA (US); Harold B. Ginder, York, PA (US); Dennis L. Deitz, Windsor, PA (US); Sakin R. Cakmakci, York, PA (US)

(73) Assignee: York International Corporation, York, PA (US)

( * ) Notice: Subject to any disclaimer, the term of this patent is extended or adjusted under 35 U.S.C. 154(b) by 0 days.

(21) Appl. No.: 10/151,242

(22) Filed: May 21, 2002

(65) Prior Publication Data

US 2002/0170304 A1 Nov. 21, 2002

Related U.S. Application Data

(60) Division of application No. 09/559,726, filed on Apr. 28, 2000, now Pat. No. 6,427,464, which is a continuation-in-part of application No. 09/232,558, filed on Jan. 15, 1999, now Pat. No. 6,202,431.

(51) Int. Cl.[7] ..... F25B 41/04; F25B 49/02
(52) U.S. Cl. ..... 62/196.3; 62/129; 62/204
(58) Field of Search ..... 62/126, 129, 196.1, 62/196.3, 203, 204, 217, 228.1, 228.3, 228.4, 228.5

(56) References Cited

U.S. PATENT DOCUMENTS

| | | | | |
|---|---|---|---|---|
| 2,739,451 | A | 3/1956 | Breck | |
| 2,888,809 | A | 6/1959 | Rachfal | |
| 3,174,298 | A | 3/1965 | Kleiss | |
| 3,250,084 | A | 5/1966 | Anderson | |
| 3,355,906 | A | 12/1967 | Newton | |
| 3,522,711 | A | 8/1970 | Shaughnessy | |
| 3,555,844 | A | 1/1971 | Fleckenstein et al. | 62/217 |
| 3,780,532 | A | 12/1973 | Norbeck et al. | |
| 4,151,725 | A | 5/1979 | Kountz et al. | |
| 4,156,578 | A | 5/1979 | Agar et al. | |
| 4,164,034 | A | 8/1979 | Glennon et al. | |
| 4,177,649 | A | 12/1979 | Venema | |
| 4,183,225 | A | 1/1980 | Politte et al. | |
| 4,248,055 | A | 2/1981 | Day, III et al. | 62/209 X |
| 4,259,845 | A | 4/1981 | Norbeck | |
| 4,275,987 | A | 6/1981 | Kountz et al. | |
| 4,282,718 | A | 8/1981 | Kountz et al. | |
| 4,282,719 | A | 8/1981 | Kountz et al. | 62/115 |
| 4,355,948 | A | 10/1982 | Kountz et al. | |

(List continued on next page.)

FOREIGN PATENT DOCUMENTS

| | | | |
|---|---|---|---|
| JP | 1281353 | | 11/1989 |
| JP | 4260755 | A | 9/1992 |
| JP | 4297761 | A | 10/1992 |
| JP | 05052433 | A | 3/1993 |
| JP | 6185786 | A | 7/1994 |

*Primary Examiner*—Harry B. Tanner
(74) *Attorney, Agent, or Firm*—Finnegan, Henderson, Farabow, Garrett & Dunner, LLP

(57) ABSTRACT

Methods and systems consistent with this invention control a hot gas bypass valve in a refrigeration system including a centrifugal compressor, a condenser, an evaporator, and a hot gas bypass line between the compressor and the evaporator. Such methods and systems continuously sense for a surge condition during operation of the refrigeration system, indicate a surge condition when the refrigeration system is operating under surge conditions, and open at least partially the hot gas bypass valve in response to the sensed surge condition to return the refrigeration system to operating under non-surge conditions. Methods and systems consistent with this invention also sense a present head parameter representative of the present head of the compressor, sense a present load parameter representative of the present load, and control the hot gas bypass valve so as to avoid surging in the compressor in response to the present head parameter, the present load parameter, and stored head and load parameters.

7 Claims, 8 Drawing Sheets

U.S. PATENT DOCUMENTS 4,522,037 A 6/1985 Ares et al.
4,546,618 A 10/1985 Kountz et al.
4,581,900 A 4/1986 Lowe et al.
4,608,833 A 9/1986 Kountz ..... 62/228.1
4,686,834 A 8/1987 Haley et al.
4,726,738 A 2/1988 Nakamura et al.
4,947,653 A 8/1990 Day et al.
RE33,620 E 6/1991 Persem
5,065,590 A 11/1991 Powell et al.
5,158,024 A 10/1992 Tanaka et al.
5,259,210 A 11/1993 Ohya et al.
5,272,428 A 12/1993 Spiegel et al.
5,284,026 A 2/1994 Powell
5,355,691 A 10/1994 Sullivan et al.
5,537,830 A 7/1996 Goshaw et al.
5,553,997 A 9/1996 Goshaw et al.
5,669,225 A 9/1997 Beaverson et al.
5,746,062 A 5/1998 Beaverson et al.
5,794,736 A 8/1998 Millard
5,873,257 A 2/1999 Peterson
5,894,736 A 4/1999 Beaverson et al.
5,947,680 A 9/1999 Harada et al.
6,202,431 B1 * 3/2001 Beaverson et al. ..... 62/196.3

* cited by examiner

| PRV INDEX | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| CONTROL PRESSURE RATIO | a | b | c | d | e | f | g | h | i | j | k | l | m | n | o | p | q | r | s | t |

HOT GAS BYPASS CONTROL FOR CENTRIFUGAL CHILLERS

This is a division of application Ser. No. 09/559,726, filed Apr. 28, 2000, U.S. Pat. No. 6,427,464 which is a Continuation in Part of application Ser. No. 09/232,558 filed on Jan. 15, 1999, U.S. Pat. No. 6,202,431, both of which are incorporated herein by reference.

BACKGROUND OF THE INVENTION

1. Field of the Invention

The present invention relates generally to the control of a centrifugal liquid chiller, and more specifically to the use of a hot gas bypass valve or another orifice in a centrifugal liquid chiller to minimize surge.

2. Description of the Related Art

As generally known, surge is an unstable condition that may occur when compressors, such as centrifugal compressors, are operated at light loads and high-pressure ratios. It is a transient phenomenon characterized by high frequency oscillations in fluid pressure and flow, and, in some cases, a complete flow reversal through the compressor. Surge, if uncontrolled, causes excessive vibrations that may result in permanent damage to the compressor. Further, surge may cause excessive electrical power consumption if the drive device is an electric motor.

It is generally known that a hot gas bypass (HGBP) flow helps avoid surge during low-load or partial-load conditions. As the cooling load decreases, the requirement for hot gas bypass flow increases. The amount of hot gas bypass flow at a certain load condition is dependent on a number of parameters and is controlled by a HGBP valve.

A HGBP valve control in the prior art provides for an analog electronic circuit that outputs a DC voltage signal that is proportional to the required opening of the valve. The prior art system, however, requires manual calibration at two different chiller operating points at which the compressor just begins to surge. As a consequence, a good deal of time is spent performing the calibration with the assistance of a service technician. Further, variation of coolant flow, which is necessary for many applications, requires repeated calibration.

Another disadvantage of the prior art is that it makes the false assumption that the "surge boundary," which defines the conditions under which the compressor would surge as a function of certain parameters, is a straight line. Instead, it is often characterized by a curve that may deviate significantly from a straight line at various parameters. This inaccuracy of the prior art may cause the HGBP valve to open prematurely, or it may allow the unit to surge unnecessarily at the operating conditions.

Thus, it is desirable to provide an automatic control system for the HGBP valve or other flow control devices to provide optimal control that is responsive to the characteristic of a given centrifugal chiller system.

SUMMARY OF THE INVENTION

This summary and the following detailed description should not restrict the scope of the claimed invention. Both provide examples and explanations to enable others to practice the invention. The accompanying drawings, which form part of the detailed description, show several embodiments of the invention and, together with the description, explain the principles of the invention.

Methods and systems consistent with this invention control a hot gas bypass valve in a refrigeration system including a centrifugal compressor, a condenser, an evaporator, and a hot gas bypass line between the compressor and the evaporator. Such methods and systems continuously sense for a surge condition during operation of the refrigeration system, indicate a surge condition when the refrigeration system is operating under surge conditions, and open at least partially the hot gas bypass valve in response to the sensed surge condition to return the refrigeration system to operating under non-surge conditions.

Methods and systems consistent with this invention control a hot gas bypass valve in a refrigeration system including a centrifugal compressor, a condenser, an evaporator, and a hot gas bypass line between the compressor and the evaporator. Such methods and systems sense a present head parameter representative of the present head of the compressor, sense a present load parameter representative of the present load, and control the hot gas bypass valve so as to avoid surging in the compressor in response to the present head parameter, the present load parameter, and stored head and load parameters.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DESCRIPTION OF THE PREFERRED EMBODIMENT

The following description of embodiments of this invention refers to the accompanying drawings. Where appropriate, the same reference numbers in different drawings refer to the same or similar elements.

Figure 1:
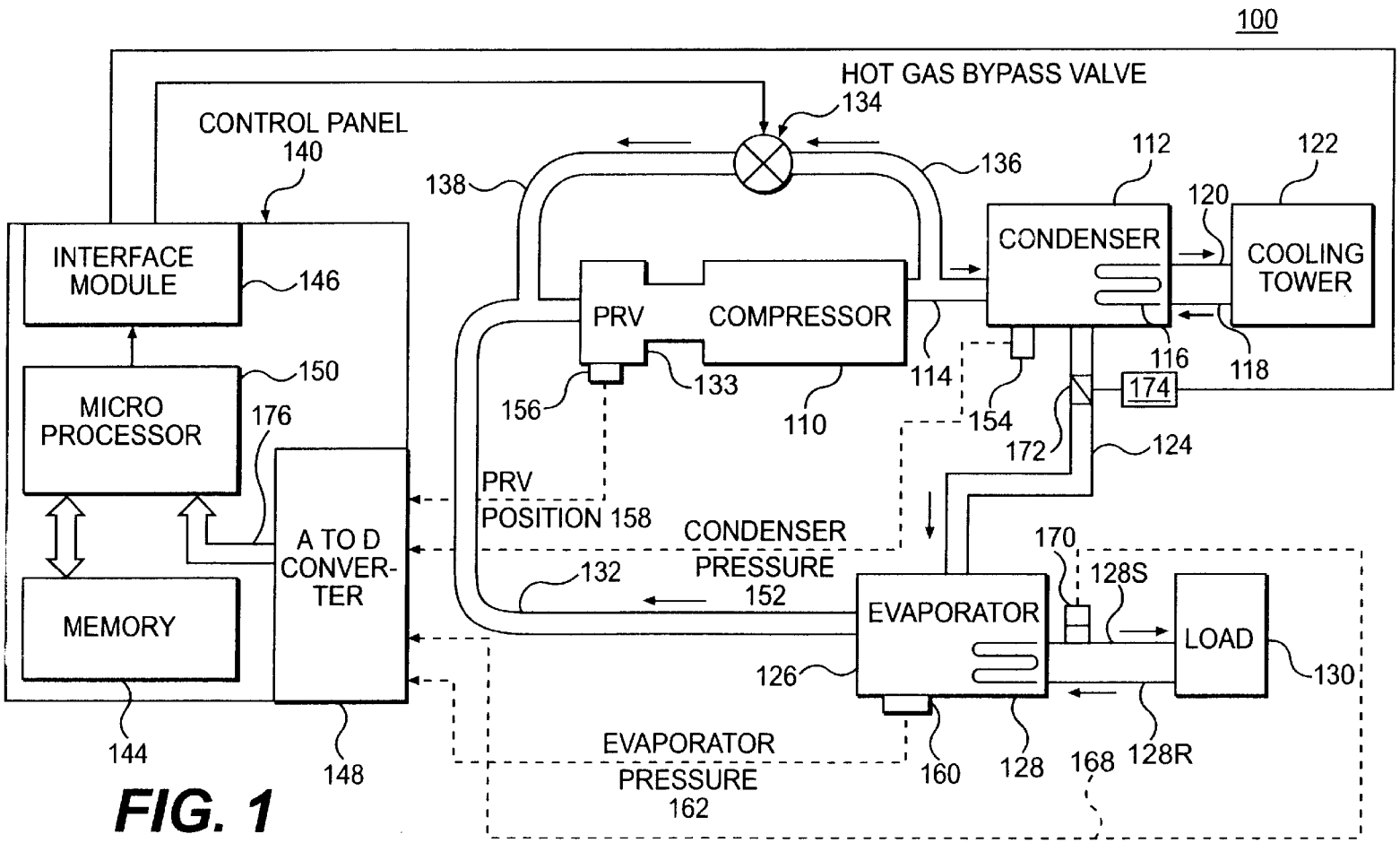
FIG. 1 is a diagram of a refrigeration system consistent with this invention.

FIG. 1 is a diagram of a refrigeration system 100 consistent with this invention. Refrigeration system 100 also includes a centrifugal compressor 110 that compresses refrigerant vapor and delivers it to a condenser 112 via a line 114. Condenser 112 includes a heat-exchange coil 116 having an inlet 118 and an outlet 120 connected to a cooling tower 122 or other cooling system. Condensed liquid refrigerant from condenser 112 flows via a line 124 to an evaporator 126. A variable orifice 172 located in line 124 causes a pressure drop that regulates the flow of liquid refrigerant to evaporator 126. In another embodiment, variable orifice 172 may be replaced by a conventional fixed orifice plate. Evaporator 126 includes a heat-exchanger coil 128 having a supply line 128S and a return line 128R connected to a cooling load 130. Vapor refrigerant in the evaporator 126 returns to compressor 110 via a suction line 132 containing pre-rotational vanes (PRV) 133. A hot gas bypass (HGBP) valve 134 is interconnected between a line 136 from the outlet of compressor 110 and a line 138 connected to an inlet of PRV 133.

A control panel 140 includes an interface module 146 for opening and closing HGBP valve 134. A valve controller 174 opens and closes variable orifice 172 (relative to its previous position) based on signals received from microprocessor 150 delivered through interface module 146. Control panel 140 also includes an analog to digital (A/ID) converter 148, a microprocessor 150, and a memory 144, preferably a non-volatile memory. Refrigeration system 100 includes many other features which are not shown in FIG. 1 and are not needed to describe or explain the present invention. These features have been purposely omitted to simplify the drawing for ease of illustration.

A pressure sensor 154 generates a DC voltage signal 152 proportional to the pressure in condenser 110. Pressure sensor 154 preferably directly senses the pressure in compressor 110, but it can also sense a pressure at other positions, as long as the sensed pressure is directly or indirectly representative of the pressure in condenser 110. A pressure sensor 160 generates a DC voltage signal 162 proportional to the pressure in evaporator 126. Again, pressure sensor 160 preferably senses the pressure in evaporator 126 directly, but it also may sense a related pressure representative of the pressure in evaporator 126. Typically, these signals 152, 162 are between 0.5 and 4.5V (DC). A PRV position sensor 156 senses the relative position of the PRV vane. For example, the sensor may be a potentiometer that provides a DC voltage signal 158 that is proportional to the position of PRV 133. A temperature sensor 170 on supply line 128S generates a DC voltage signal 168 proportional to the chilled water temperature leaving evaporator 126 (LCHWT). Again, temperature sensor 170 preferably senses the temperature of the chilled water (or other fluid) as it leaves the evaporator, but it can also sense a temperature that is related and representative of the temperature of the chilled water leaving evaporator 126.

The four analog DC voltage signals 158, 152, 162, and 168 are inputs to control panel 140 and are converted to digital signals 176 by A/D converter 148. Digital signals 176 are inputs to microprocessor 150. Software that runs microprocessor 150 performs all necessary calculations and decides what the HGBP valve 134 position and variable orifice 172 position should be, as described below, as well as other functions. One of these functions is to electronically detect surge in compressor 110 and then move HGBP valve 134 and/or variable orifice 172 to more open or more closed positions according to sensed parameters and preselected criteria stored in memory 144. Microprocessor 150 controls HGBP valve 134 and valve controller 174 through interface module 146. Microprocessor 150 may run an application that resides in memory 144 to control elements of system 100.

Figure 2:
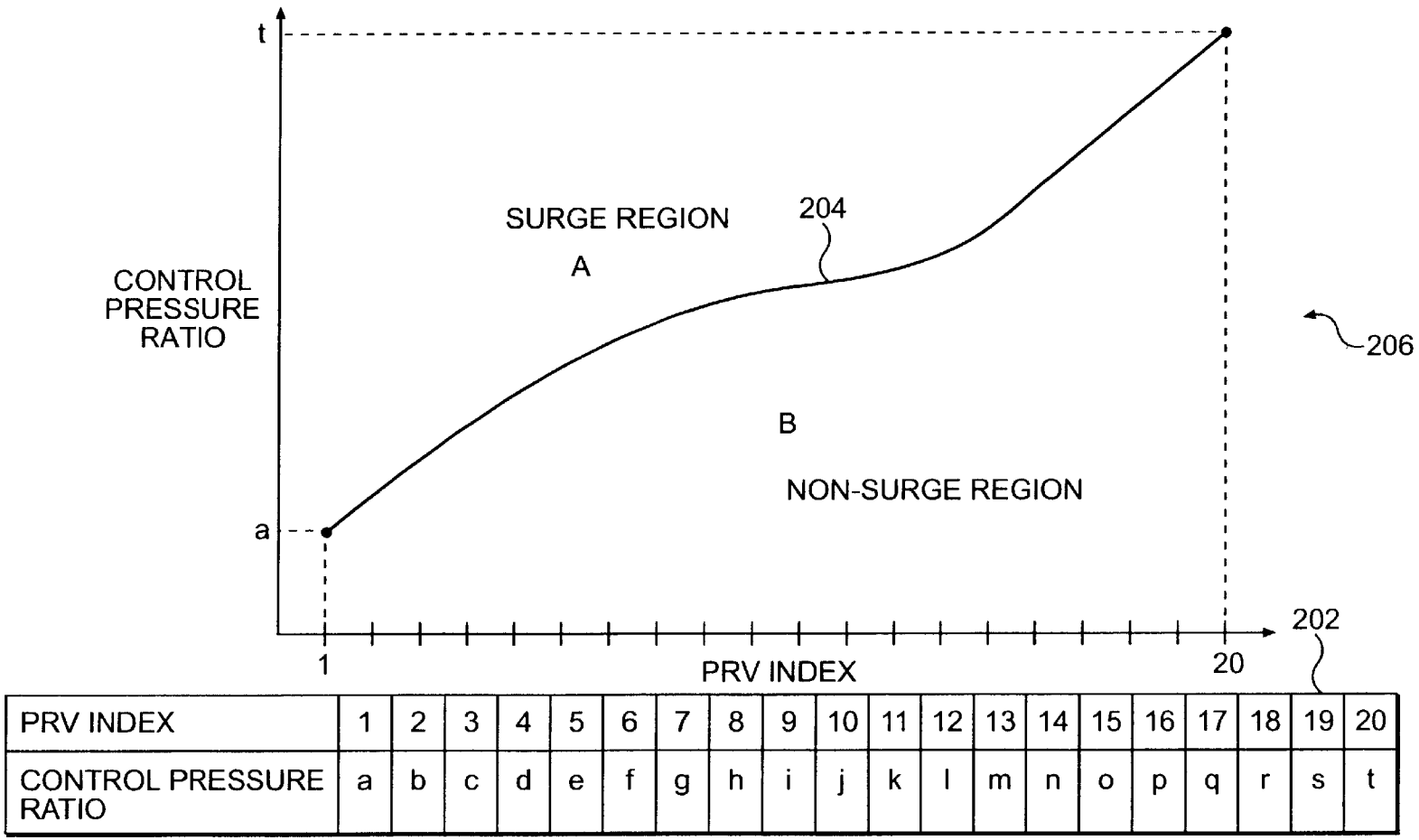
FIG. 2 is a plot of a surge boundary curve and a table that stores data points that define the surge boundary curve, all consistent with this invention.

Methods and systems consistent with this invention adaptively determine the position of HGBP valve 134 as system 100 operates by using a surge boundary curve. An adaptive hot gas bypass (adaptive HGBP or AHGBP) process may create a surge boundary curve, which represents the conditions under which surge occurs as a function of system parameters. Two system parameters that may be used to define the surge boundary curve are (1) the chiller cooling load, and (2) the compressor head. FIG. 2 is a plot 206 of a surge boundary curve 204 and a table 202 that stores data points that define the surge boundary curve 204, all consistent with this invention. Table 202 may be stored in memory 144. Curve 204 defines two regions: (1) surge region A and (2) non-surge region B.

In the preferred embodiment, the chiller cooling load is represented by PRV position 158 and the compressor head is represented by the control pressure ratio. The control pressure ratio is described in more detail below. Table 202 stores the PRV index, which corresponds to PRV position 158, and the control pressure ratio. The values stored in table 202 correspond to curve 204. Thus, the PRV index is on the abscissa (x-axis) and the control pressure ratio is on the ordinate (y-axis) of plot 206.

Surge boundary curve 204 is useful while refrigeration system 100 is operating under non-surge conditions in non-surge region B, where HGBP valve 134 is closed, to identify the conditions that would drive compressor 110 into surge, i.e., into surge region A. Once refrigeration system 100 is operating under surge conditions, however, surge boundary curve 204 may not indicate the parameters defining the surge and non-surge regions. This characteristic is true because while HGBP valve 134 is open, either alone or in combination with variable orifice 174, the PRV position becomes uncorrelated to the actual surge boundary. When HGBP valve 134 is fully or partially open, system 100 is said to be operating in the "HGBP region." Therefore, while system 100 operates under non-surge conditions (in non-surge region B), surge boundary curve 204 indicates the conditions under which system 100 would surge (i.e., enter surge region A). Curve 204 may also be useful for other information as to the surge characteristics of the compressor.

In the preferred embodiment, methods and systems consistent with this invention may determine surge boundary curve 204 during operation of system 100. Also, surge boundary curve 204 may be updated and changed during operation of system 100. For instance, initially table 202 may have no control pressure values. Surge boundary curve 204 and the values in table 202 may be determined by detecting compressor 110 surge as it begins to take place (while system 100 was previously operating under non-surge conditions), and storing values that represent the compressor head and chiller load, i.e., the surge point, in table 202. The surge point may not be stored in all circumstances, however. The surge point may not be stored if system 100 conditions are unstable. System 100 conditions may be unstable, for instance, if the rate of change of the leaving chilled water temperature is greater than approximately 0.3° F. per second. The leaving chilled water temperature (LCHWT) 128S is obtained via sensor 170, and its rate of change may be calculated. The control pressure ratio in table 202 may be periodically cleared to reconstruct surge boundary curve 204 and the values in table 202.

Control pressure ratios in table 202 may be organized relative to a PRV index value that corresponds to PRV position 158. For example, a given PRV position may be converted into a percentage from zero to 100%. Zero percent may represent closed vanes, and 100% may represent wide open vanes. A present PRV index value of 1 could represent a PRV percentage of zero to 5%. A present PRV index value of 2 could represent a PRV percentage of 5% to 10%, etc. The PRV index in table 202 ranges from 1 to 20, and the corresponding stored control pressure ratios for each PRV index are represented by the letters "a" through "t," respectively. Alternatively, table 202 can store other information such as evaporator pressure 162, condenser pressure 152, PRV position 158, among other data that may be useful for determining the conditions under which surge would occur. Another, preferred method for determining the PRV index is described below with respect to FIG. 3C.

In the preferred embodiment, the method and system disclosed in U.S. Pat. No. 5,764,062, hereby incorporated by reference, is used to detect a surge condition. Thus, if a surge event begins to occur when system 100 was previously operating under non-surge conditions, the process of the invention determines the control pressure ratio and PRV position 158 and may create a new point on surge boundary curve 204.

As mentioned above, in the preferred embodiment, PRV position 158 represents the chiller load. Use of the PRV position may minimize variations due to flow. Various other parameters, however, may represent the chiller load. For instance, U.S. Pat. No. 4,248,055, hereby incorporated by reference, represents the chiller cooling load as the difference between evaporator returning chilled water 128R temperature (RCHWT) and leaving chilled water 128S temperature (LCHWT).

Various parameters may be used to represent the compressor head. For example, U.S. Pat. No. 4,248,055, hereby incorporated by reference, represents compressor head by the condenser water liquid temperature (CLT). As mentioned above, in the preferred embodiment the pressure ratio represents the compressor head. This is similar to the method and system in U.S. Pat. No. 4,282,719, hereby incorporated by reference, which also represents compressor head by a pressure ratio. The pressure ratio is defined as condenser pressure 152 minus evaporator pressure 162, that quantity divided by evaporator pressure 162. An "average pressure ratio" is defined as the average value of the present calculated pressure ratio and a number of past calculated pressure ratios. In the preferred embodiment, methods and systems consistent with this invention use the average pressure ratio. When the average pressure ratio is entered into table 202 it is referred to as the "control" pressure ratio because system 100 operates based upon table 202 entries. Averaging may limit erroneous values as a result of fluctuations in the pressure ratio due to surges.

Figure 3A:
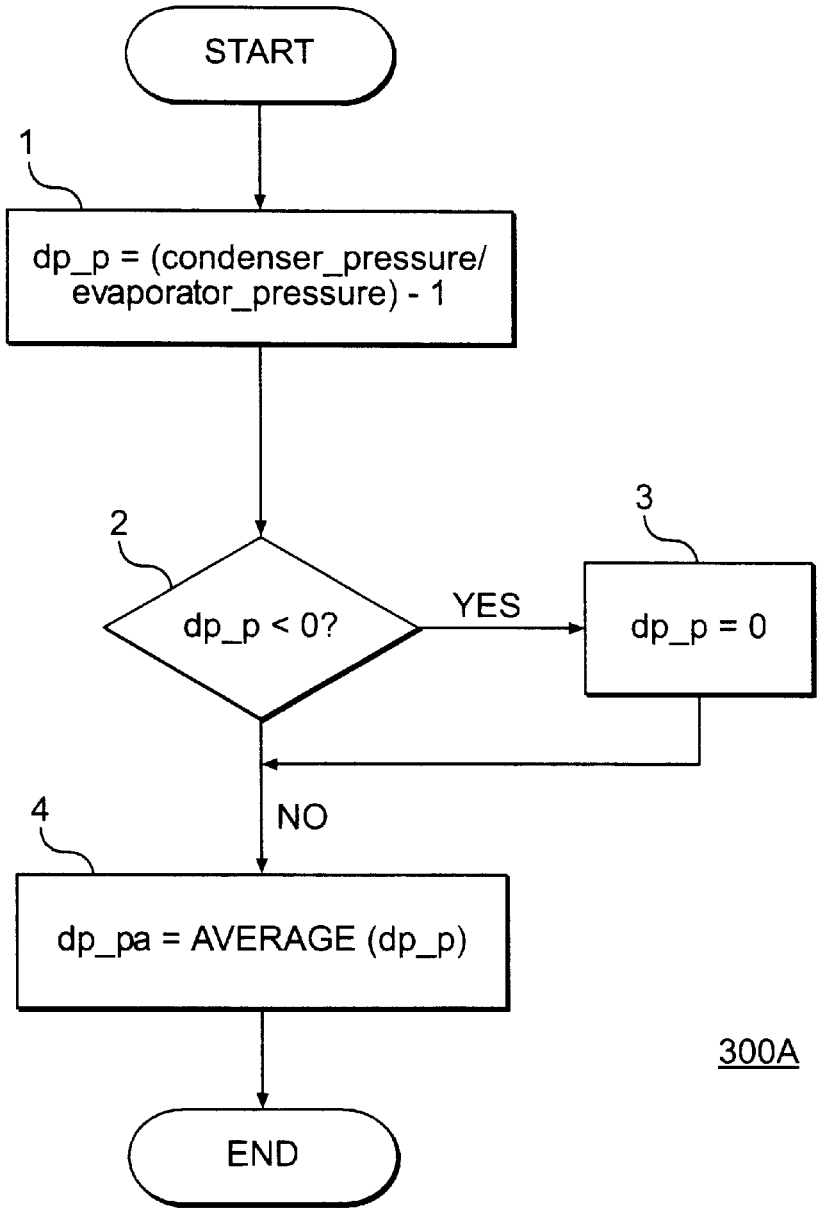
FIGS. 3A, 3B, and 3C are flow charts of a control process, consistent with this invention, using the surge boundary curve of FIG. 2.

FIG. 3A is a flow chart of a process 300A, consistent with this invention, for determining the average pressure ratio. When control process 300A starts, the present pressure ratio (dp_p) is assigned the value of (condenser pressure 152/evaporator pressure 162)−1, which is equal to ((condenser pressure 152−evaporator pressure 162)/evaporator pressure 162)

(step 1). The pressure ratio should only have positive numbers. Therefore, if the present pressure ratio (dp_p) is negative (step 2), it is set equal to zero (step 3). Next, the average present pressure ratio (dp_pa), is assigned the average value of the past N number of pressure ratios, including the present pressure ratio (step 4). In the preferred embodiment, N is equal to ten.

Figure 3B:
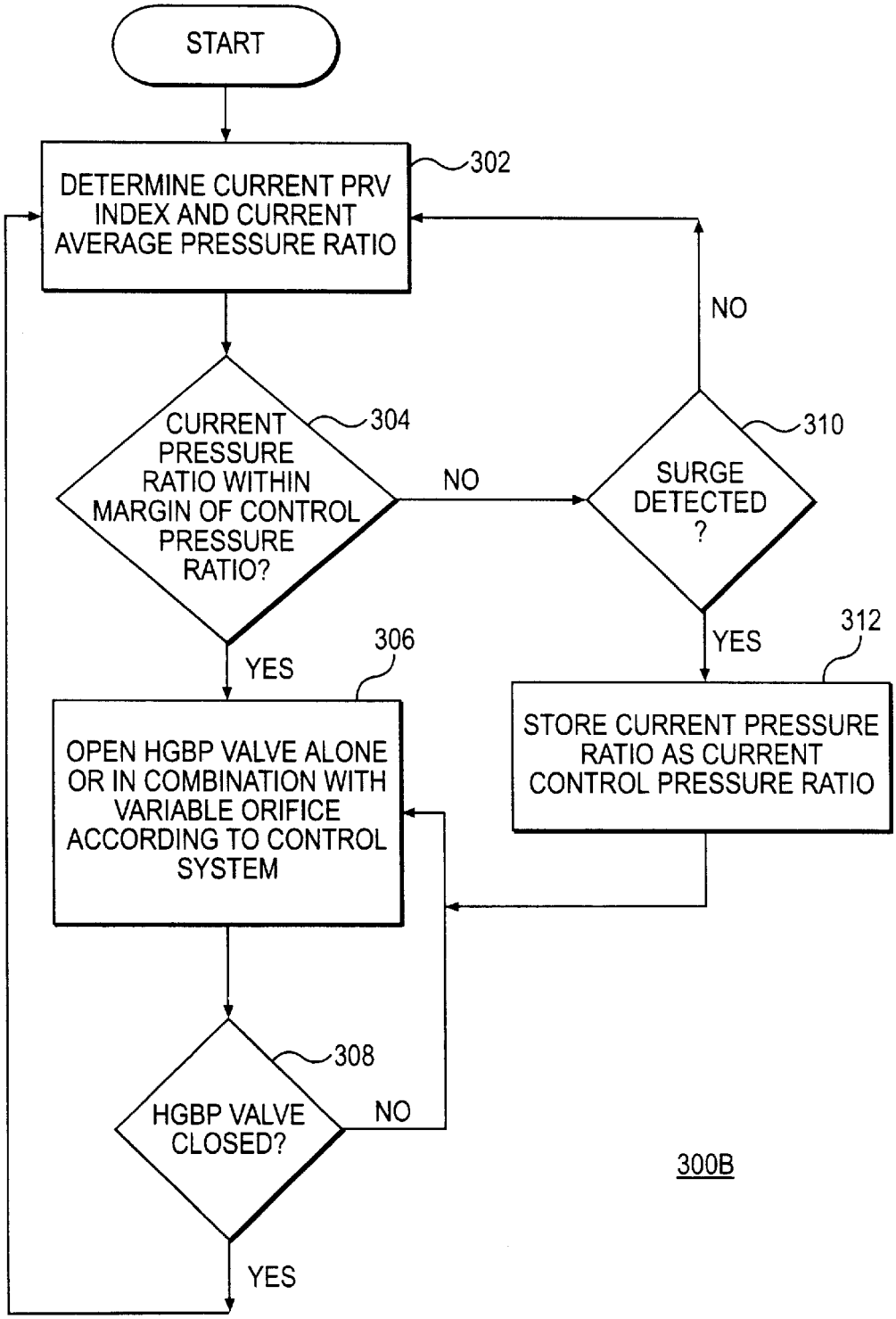

FIG. 3B is a flow chart of a process 300B, consistent with this invention, for controlling HGBP valve 134. Process 300B determines the present average pressure ratio and PRV index (step 302). A more detailed method for determining the PRV index is described below with respect to FIG. 3C. If the present average pressure ratio at the present PRV index is within a programmable surge margin below the control pressure ratio (step 304) and system 100 is in the non-surge region B, methods and systems consistent with this invention partially or fully open HGBP valve 134 alone or in combination with variable orifice 172 (step 306). In the preferred embodiment, the programmable surge margin is 0.1. If surge is detected below the programmable surge margin (step 310), then the control pressure ratio stored in table 200 is overwritten with the present average pressure ratio at the present PRV index determined in step 302 (step 312) and process 300B proceeds to step 306. After HGBP valve 134 is opened, however, the position of HGBP valve 134 is controlled by surge detection as described below with respect to FIGS. 4B–4C (step 306). System 100 operates under surge conditions until conditions warrant the closing of HGBP valve 134 completely (step 308), at which time system 100 operates under non-surge conditions in non-surge region B as defined by surge boundary curve 204.

Figure 3C:
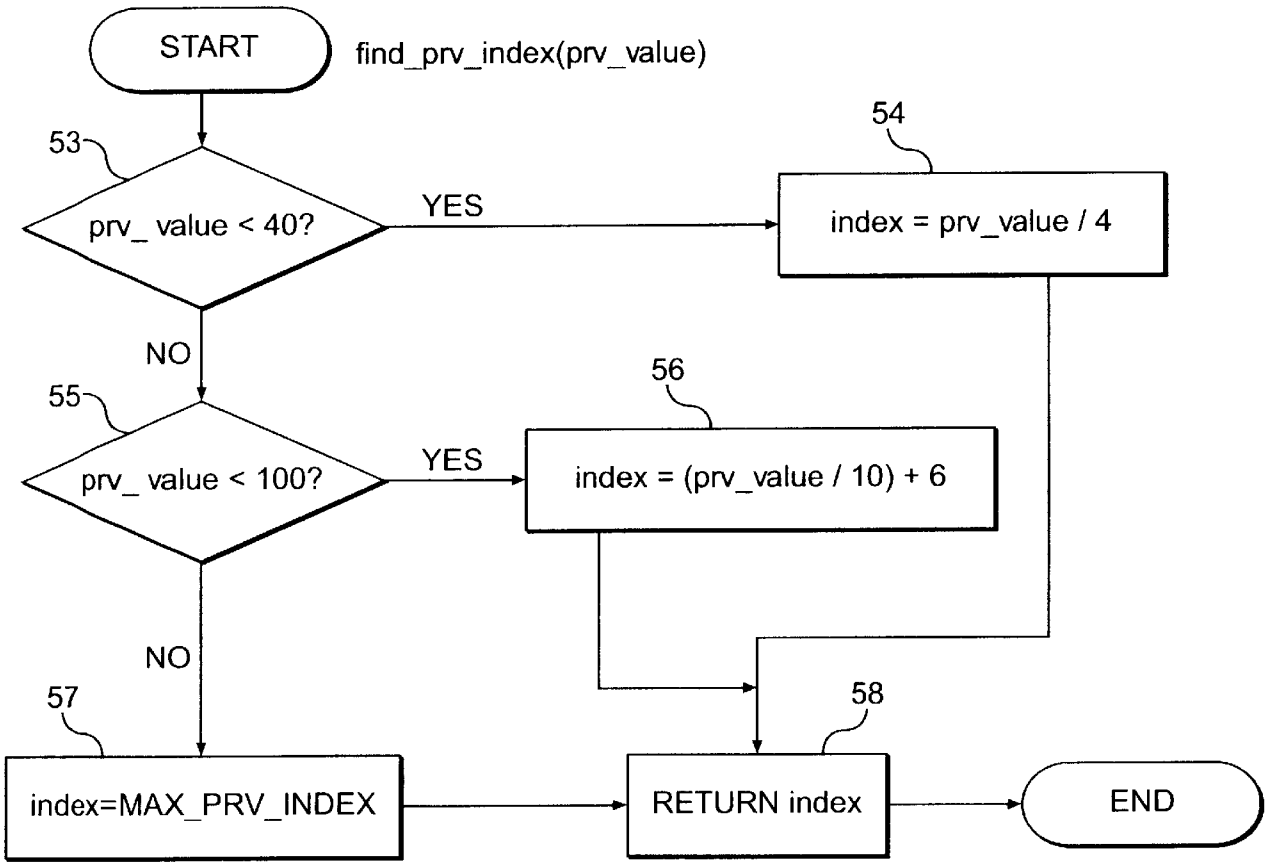

FIG. 3C is a flow chart of a process 300C for determining the PRV index (prv_index) for the stored control pressure ratios. Pre-rotational vanes 133 may be wide open, which corresponds to a value of 100%, they may be closed, which corresponds a value of 0%, or they may be anywhere in between. If the PRV value (prv_value) is less than 40% (step 53), then the index value returned (step 58) is the PRV value divided by four (step 54). If the PRV value is not less than 40% (step 53), but is less than 100%, then the index returned (step 58) is the PRV value divided by ten, plus six. If the PRV value is not less than 100% (step 55) then the index returned (step 58) is the maximum value allowed (max_prv_index) in step 57. In the preferred embodiment, the maximum value allowed is 15, and the PRV value ranges between zero and 100%. Alternatively, other PRV index algorithms are possible.

Figure 4A:
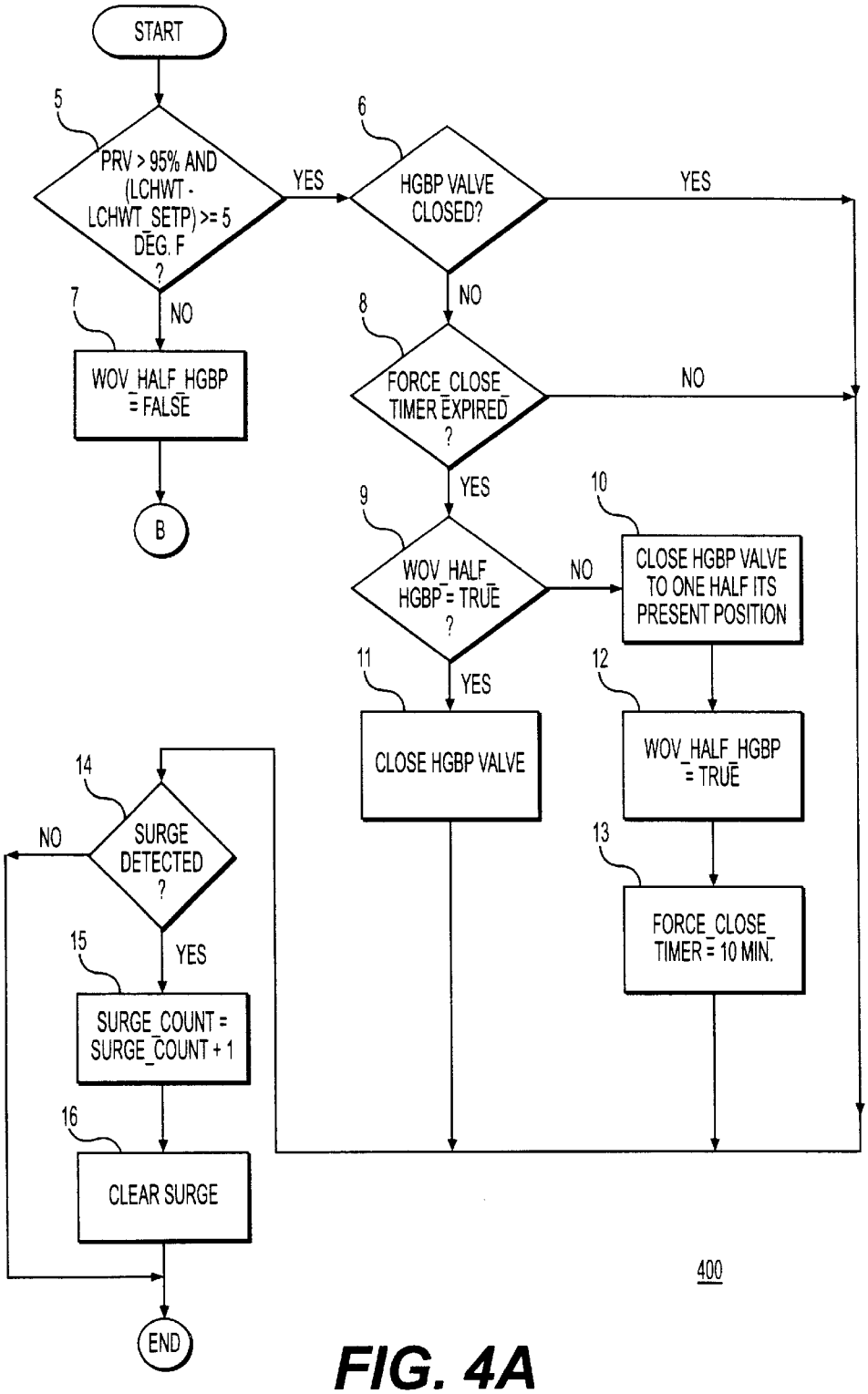
FIGS. 4A, 4B, and 4C are flow charts of a control process, consistent with this invention, that may operate without the surge boundary curve of FIG. 2.
Figure 4B:
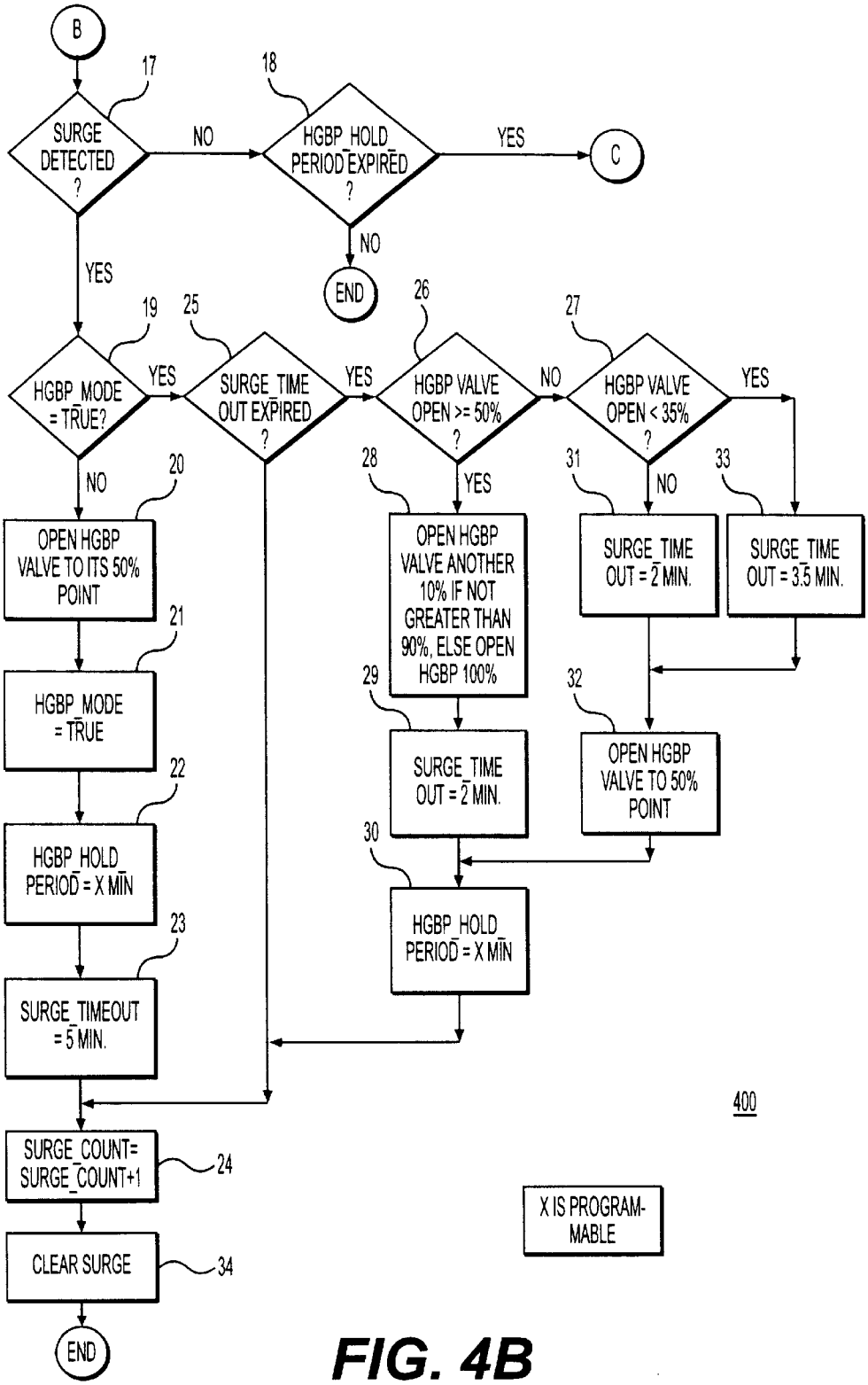
Figure 4C:
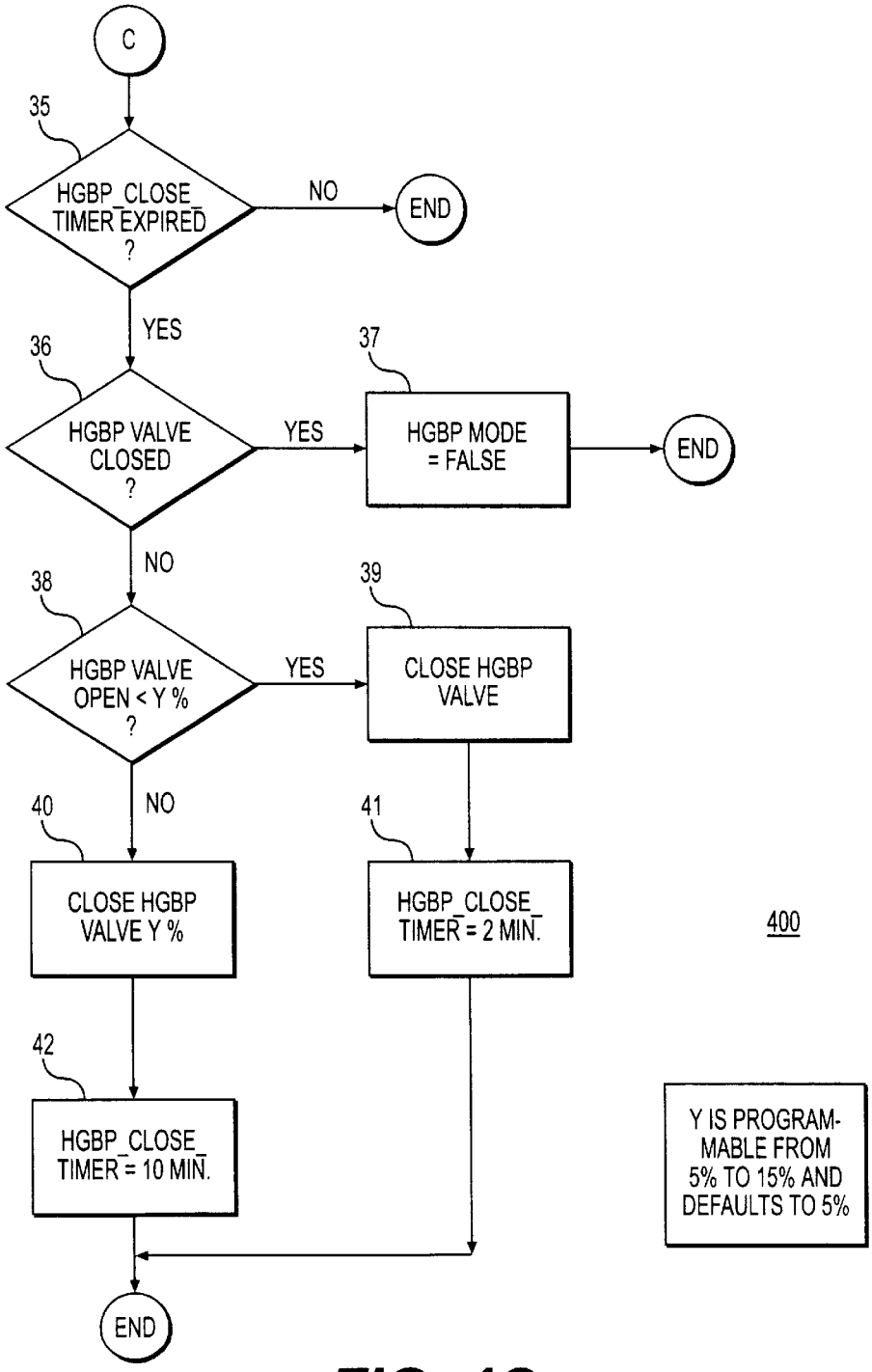

Methods and systems consistent with this invention may also vary the position of HGBP valve 134 alone or with variable orifice 172 through surge detection without the use of surge boundary curve 204. FIGS. 4A–4C are flow charts of control process 400, consistent with this invention, for controlling HGBP valve 134 alone or in combination with variable orifice 172. Microprocessor 150 periodically executes AHGBP control process 400. For instance, microprocessor 150 may execute control process 400 once per second or once every few minutes.

Before process 400 executes for the first time certain flag variables and timer variables are reset. For instance, flags used during process 400 are SURGE, HGBP_MODE and WOV_HALF_HGBP. These flags are set to FALSE. Timers used during process 400 are FORCE_CLOSE_TIMER, SURGE_TIMEOUT, HGBP_HOLD_PERIOD, and HGBP_CLOSE_TIMER. These timers are set to zero. Then process 400 may start its first execution loop.

If the LCHWT 128S is greater than or equal to a temperature margin, preferably 5° F., and PRV position 158 is greater than 95% (step 5), then process 400 proceeds to steps 6 and 8–13. The purpose of steps 6 and 8–13 is to drive the LCHWT to setpoint because a PRV opening greater than 95%, which corresponds to nearly wide open vanes (WOV), does not provide enough control range to drive the LCHWT to set point adequately. By closing HGBP valve 134, less gas is bypassed and this produces more capacity to bring the LCHWT back to setpoint. Percentages smaller than 95% could also be used to indicate nearly wide open vanes, such as 90% or 85%.

If HGBP valve 134 is not closed (step 6), then chiller 100 is still operating in the HGBP region, and a timer FORCE_CLOSE is checked to see if it has expired (step 8). The FORCE_CLOSED timer measures an amount of time to lapse between incrementally closing HGBP valve 134. If the timer FORCE_CLOSE_TIMER expired, a flag WOV_HALF_HGBP is checked to see if it is TRUE (step 9). If WOV_HALF_HGBP is FALSE, HGBP valve 134 is closed to half of its present position (step 10), the WOV_HALF_HGBP flag is set TRUE (step 12), and the FORCE_CLOSE_TIMER is set for ten min (step 13). The WOV_HALF_HGBP flag allows process 400 to close HGBP valve 134 half way the first increment of closure, and all the way for the second increment of closure. If the conditions of step 5 are TRUE, if HGBP valve 134 is not closed (step 6), if the FORCE_CLOSE_TIMER expired (step 8), and the WOV_HALF_HGBP flag is TRUE (step 9), HGBP valve 134 is closed completely (step 11).

While AHGBP process 400 is executed, a separate surge detection process continuously detects whether surge conditions are present in compressor 110. The surge detection process may detect whether surge conditions are present at a sufficient rate such that a surge condition does not go undetected. For example, the surge detection process may detect whether surge conditions are present every second or once every few minutes. As stated above, the preferred method of detecting surge conditions is discussed in U.S. Pat. No. 5,764,062. When the surge detection process detects a valid surge, it flags it by setting a flag SURGE to TRUE. Thus, process 400 detects surge when the surge flag is TRUE. Additional steps employed as a result of step 5 being TRUE are (1) checking to see if surge is detected (step 14), (2) incrementing the number of surges (step 15), and (3) clearing the flag SURGE flag (step 16). At this point, process 400 ends and may be restarted. Closing HGBP valve 134, as a remedy to step 5 being TRUE, may result in excessive surging. Thus, it is important that steps 14–16 keep track of the number of surges. The chiller may be shut down if a programmable number of surges occur within a given programmable period of time. Preferably, the chiller shuts down when the number of surges reaches 20 surges in 5 minutes, but other values are possible. When step 5 becomes FALSE, the WOV_HALF_OPEN flag is set to FALSE (step 7) and process 400 proceeds to the main HGBP control of FIGS. 4B–4C.

The interaction of the control features described in FIGS. 4B–4C position HGBP valve 134 in an optimum position based on surge detection. If surge is detected (step 17), process 400 determines whether system 100 is operating in the HGBP region by checking the HGBP_MODE flag, i.e. HGBP valve 134 is not closed (step 19). If it is not in the HGBP region, HGBP valve 134 is opened partially (step 20). The value of 50% shown in step 20 is a preferred value for the initial HGBP valve 134 opening. In other embodiments, values may be used other than 50% such as 30% or 40%, for example. Opening HGBP valve 134 results in the control transitioning from the normal region to the HGBP region of operation. Thus, the HGBP_MODE flag is set TRUE to indicate that system 100 is now operating in the HGBP region (step 21).

Next, a timer HGBP_HOLD_PERIOD is set to a programmable value (step 22). In the preferred embodiment, HGBP_HOLD_PERIOD may range from 30 to 120 minutes but other ranges are possible (step 22). This time period is the time in which HGBP valve 134 is held open in this position before it is incrementally closed, assuming no more surges occur in this time period. Another timer SURGE_TIMEOUT is set to a value (step 23). In the preferred embodiment, SURGE_TIMEOUT is set to five minutes (step 23). In other embodiments, other values may be used. This interval of time is required to allow system 100 to adjust HGBP valve 134 to opening conditions before permitting further action to be taken in opening HGBP valve 134 due to another surge event.

Methods and systems consistent with this invention incrementally open the hot gas bypass valve further surge conditions continues to exist. If step 19 is TRUE, i.e. system 100 is in the HGBP region, no further action will be taken on the movement of HGBP valve 134 until SURGE_TIMEOUT has expired (step 25). Either way, steps 24 and 34 count the surge and clear the flag SURGE in preparation for the next possible surge. If SURGE_TIMEOUT has expired (step 25), system 100 checks if the present position of HGBP valve 134 is greater than or equal to a value, for example 50% (step 26). In other embodiments, values other than 50% may be used. If step 26 is TRUE, HGBP valve 134 is opened another 10% if its present position is not greater than 90%, otherwise it is opened to 100% (step 28). Timer SURGE_TIMEOUT is reset to two minutes (step 29), i.e. additional surges during this timer interval do not cause additional HGBP valve 134 movement.

If HGBP valve 134 is not open greater than or equal to 50% (step 26), process 400 determines if it is open less than a value, for example 35% (step 27). Again, values other than 35% are possible. If it is not, SURGE_TIMEOUT is reset for two minutes (step 31), otherwise SURGE_TIMEOUT is reset to 3.5 minutes (step 33). Other timer values are possible. Either way, HGBP valve 134 is opened to its 50% opening point (step 32) and timer HGBP_HOLD_PERIOD is reset to a programmable value (step 30), which may range from 30 to 120 minutes. In other embodiments, values other than this range are possible. Because the execution of steps 26 through 33 are in response to a detected surge event, the surge count is incremented (step 24) and flag SURGE is cleared (step 34).

Methods and systems consistent with this invention incrementally close the hot gas bypass valve if surge conditions no longer exists. For example, after the conditions stabilize and surge stops, step 17 is FALSE and process 400 checks if the timer HGBP_HOLD_PERIOD has expired (step 18). If it has expired (step 18), process 400 ends and may be restarted. If it has not expired (step 18), HGBP valve 134 is held in its present position until it expires or surge occurs. As described above, HGBP_HOLD _PERIOD is the time in which HGBP valve 134 is held open before it is incrementally closed, assuming no more surges occur in this time period. If surge occurs (step 17), then HGBP valve 134 position is increased in accordance with steps 26 through 33.

When the timer HGBP_HOLD_PERIOD expires (step 18), timer HGBP_CLOSE_TIMER is checked (step 35) and if it is not expired, process 400 ends and is restarted, thus holding HGBP valve 134 in its present position until timer HGBP CLOSE_TIMER does expire. The HGBP_CLOSE_TIMER provides the delay required to slowly move HGBP valve 134 back to its closed position. As discussed above, when system 100 is powered-up, all timers are initialized to zero. The timer HGBP_CLOSE_TIMER is expired either (1) when first checked or (2) when enough time has elapsed to cause it to expire. After timer HGBP_CLOSE_TIMER is expired (step 35), process 400 checks to see if HGBP valve 134 is closed (step 36). If it is closed, conditions have changed to the point where the non-HGBP region of operation has been re-entered. Thus, the HGBP_MODE flag is set to FALSE (step 37), and process 400 ends and may be restarted. Otherwise, if HGBP valve 134 is not closed (step 36), process 400 checks to see if HGBP valve 134 is less than a programmable value Y (step 38). Programmable value Y may range from 5 to 15%, but other values are possible. If it is, HGBP valve 134 is closed all the way (step 39) and timer HGBP_CLOSE_TIMER is set for two minutes (step 41). Otherwise, if step 38 is FALSE, HGBP valve 134 is closed an additional amount, and the timer HGBP_CLOSE_TIMER is set for ten minutes (step 42).

Additionally, variable orifice 172 may be controlled in conjunction with logic statements to the control HGBP valve 134. For instance, if surge is detected (step 17) then the variable orifice 172 and HGBP valve 134 may be opened in combination until surge stops. Timers mentioned in FIGS.

4C–4D may time for both variable orifice 172 and HGBP valve 134. Therefore, because variable orifice 172 may function similar to an additional HGBP valve, not only may surge be prevented earlier, but non-surge operation can be re-established sooner. Additionally, variable orifice 172 may be controlled with fuzzy logic as disclosed in U.S. Pat. No. 5,809,795, hereby incorporate by reference, to maintain the condenser liquid refrigerant level at a value that minimizes or prevents gas bypass to the evaporator.

As mentioned above, it is possible to combine the surge boundary curve 204 with the operation of process 400 shown in FIGS. 4A–4C. For instance, in order to avoid the initial surge occurrence when operating conditions approach surge boundary curve 204 from non-surge region B of operation, additional logic statements could be included in conditional step 17. If the actual pressure ratio is within the stored control average pressure ratio minus the programmable surge margin, i.e., that the surge region A is being approached, then steps 20 through 23 of FIG. 4B may then be executed and the control may operate as described above.

Also, because surge boundary curve 204 may be derived or updated when surge is detected while system 100 operates in non-surge region B, an additional step may be inserted between steps 19 and 20 of FIG. 4B to record the surge point.

In an alternative embodiment, the system parameters that may define the surge boundary curve are the compressor head and the suction volumetric flow rate for various speeds of the compressor. This surge boundary curve may be compared with the values of the compressor head and suction volumetric flow during the operation of the chiller to determine when to open HGBP valve 134 to prevent entering the surge region.

Those skilled in the art recognize that various modifications and variations can be made in the preceeding examples without departing from the scope or spirit of the invention. For instance, surge curve 204 is determined during a calibration process.

The description of the invention does not limit the invention. Instead, it provides examples and explanations to allow persons of ordinary skill to appreciate different ways to practice the invention. The following claims define the true scope and spirit of the invention.

What is claimed is:

1. A method for automatically calibrating a surge control of a refrigeration system including a centrifugal compressor having pre-rotational vanes, a condenser, an evaporator, and a hot gas bypass line between the compressor and the evaporator, said method comprising the steps of:

continuously sensing for a surge condition during operation of the refrigeration system; and sensing a head parameter representative of the head of the compressor;

sensing a load parameter representative of a load; and storing the head parameter and the load parameter when the surge condition is sensed as control data to be used by the control of the refrigeration system.

2. The method of claim 1, wherein sensing the head parameter includes sensing a pressure representative of the pressure of the liquid refrigerant in the condenser;

sensing a pressure representative of the pressure of the liquid refrigerant in the evaporator;

calculating a differential pressure equal to the difference between the condenser pressure and the evaporator pressure; and calculating a pressure ratio equal to the ratio of the calculated differential pressure and the evaporator pressure.

3. The method of claim 2, wherein sensing the load parameter includes sensing a position representative of the position of the pre-rotational vanes.

4. The method of claim 1, further comprising:

sensing a present head parameter representative of the present head of the compressor;

sensing a present load parameter representative of the load; and controlling the hot gas bypass valve so as to avoid surging in the compressor in response to the present head parameter, the present load parameter, and the stored head and load parameters.

5. The method of claim 4, wherein sensing the present head parameter includes sensing a present pressure representative of the present pressure of the liquid refrigerant in the condenser;

sensing a present pressure representative of the present pressure of the liquid refrigerant in the evaporator;

calculating a present differential pressure equal to the difference between the present condenser pressure and the present evaporator pressure;

calculating a present pressure ratio equal to the ratio between the present calculated differential pressure and the present evaporator pressure; and wherein sensing the present load parameter includes sensing a present position representative of the present position of the pre-rotational vanes.

6. The method of claim 5, further including the step of opening the hot gas bypass valve, if the present pressure ratio is within a margin of the stored control pressure ratio corresponding to the stored control vane position equal to the present vane position.

7. The method of claim 6, wherein the margin is 0.1.

* * * * *

UNITED STATES PATENT AND TRADEMARK OFFICE

CERTIFICATE OF CORRECTION

PATENT NO. : 6,691,525 B2
DATED : February 17, 2004
INVENTOR(S) : Gregory K. Beaverson et al.

It is certified that error appears in the above-identified patent and that said Letters Patent is hereby corrected as shown below:

Column 10,
Line 18, "claim 2" should read -- claim 1 --.

Signed and Sealed this

Eighteenth Day of May, 2004

JON W. DUDAS
*Acting Director of the United States Patent and Trademark Office*